United States Patent [19]

Bilt

[11] Patent Number: 4,754,572

[45] Date of Patent: Jul. 5, 1988

[54] MOTOR-OPERATED SLIDING DOOR ASSEMBLY

[75] Inventor: Michael M. Bilt, Boynton Beach, Fla.

[73] Assignee: M. Bilt Enterprises, Inc., Boynton Beach, Fla.

[21] Appl. No.: 27,415

[22] Filed: Mar. 18, 1987

Related U.S. Application Data

[63] Continuation-in-part of Ser. No. 896,014, Aug. 13, 1986, Pat. No. 4,672,773.

[51] Int. Cl.[4] ..... E05F 11/00

[52] U.S. Cl. ..... 49/358; 49/139

[58] Field of Search ..... 49/358, 359, 139, 140

[56] References Cited

U.S. PATENT DOCUMENTS

| | | | |
|---|---|---|---|
| 1,631,416 | 6/1927 | Howard | 49/358 |
| 1,694,431 | 12/1928 | Russell et al. | 49/358 |
| 3,257,765 | 6/1966 | Mealer | 49/264 |
| 3,462,883 | 8/1969 | Reeks et al. | 49/360 |
| 3,606,699 | 9/1969 | Robinson, Jr. | 49/280 |
| 3,775,906 | 12/1973 | Dougherty | 49/358 |
| 4,162,592 | 7/1979 | Taniwaki | 49/358 |
| 4,520,592 | 6/1985 | Holloway | 49/358 |
| 4,672,773 | 6/1987 | Bilt | 49/139 X |

OTHER PUBLICATIONS 1011, 1975, Norco Manufacturing Corporation Bulletin.

M. Bilt Enterprises, "Well Bilt Hangar Door Systems" Bulletin.

*Primary Examiner*—Philip C. Kannan

*Attorney, Agent, or Firm*—Oltman and Flynn

[57] ABSTRACT

A motorized drive unit for a horizontally sliding door section comprising a unitary housing assembly holding a drive motor and a floor-engaging wheel driven from the motor. A vertical lead screw fixedly positioned vertically on this housing assembly threadedly engages a nut fixedly positioned on the door section, so that the wheel can be raised from engagement with the floor. The housing assembly is slidable vertically on a support plate attached to the door section. A support member for the nut is attached to the same support plate.

10 Claims, 3 Drawing Sheets

MOTOR-OPERATED SLIDING DOOR ASSEMBLY

CROSS-REFERENCE TO RELATED APPLICATION

This application is a continuation-in-part of my co-pending U.S. patent application Ser. No. 06/896,014, filed Aug. 13, 1986, now U.S. Pat. No. 4,672,773.

This invention relates to a motor-operated sliding door assembly, such as for an aircraft hangar.

BACKGROUND OF THE INVENTION

Previously, sliding doors on aircraft hangars have been equipped with electric-motor operated drives mounted on the inside or outside of the door and having a rubber-tired motor-driven wheel engaging the floor.

For example, an arrangement manufactured by Norco Manufacturing Corporation, Racine, Wis., has the drive unit bolted onto the door either on the front (at the outside of the building) or on the back (at the inside of the building) and positioning a rubber-tired wheel engaging the floor. The geared motor in this drive unit acts as a brake when the motor is not on so that, with the rubber-tired wheel engaging the floor, if the drive unit becomes disabled the door cannot be moved by a person pushing on it unless the drive unit is first removed from the door, which takes considerable time and effort.

SUMMARY OF THE INVENTION

The present invention relates to a motorized drive unit for attachment to a sliding door which overcomes the difficulty just mentioned.

In accordance with this invention, a motorized drive unit for a sliding door is releasably attachable to the door and has means for quickly and conveniently raising its motor-driven floor-engaging wheel off the floor so that the door can be opened or closed by a person pushing on it, for example, if the motor-operated drive unit becomes disabled.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
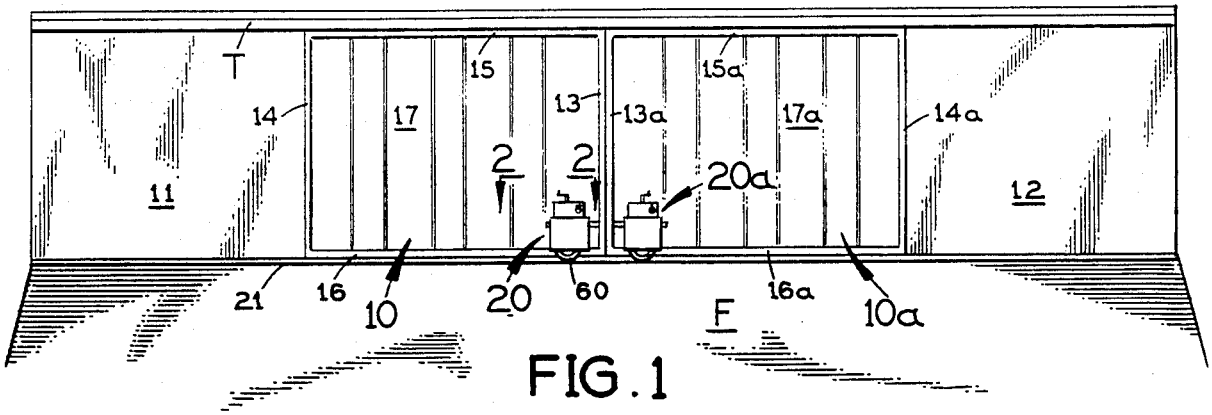
FIG. 1 is an elevational view from the inside of a building showing two motor-operated sliding doors in accordance with the present invention.

FIG. 1 shows four neighboring doors on a building, such as an aircraft hangar. These doors include a first motor-operated sliding door section or master leaf 10 which can be slid to the left on the outside or inside of a door section 11 next to it, and a second motor-operated door section or master leaf 10*a* which can be slid to the right on the outside or inside of a door section 12 next to it. FIG. 1 shows all the door sections closed, with the two motor-operated door sections 10 and 10*a* abutting end-to-end.

The motor-operated door section 10 has the usual hangar door construction, with a rectangular marginal frame made up of vertically elongated opposite end pieces 13 and 14, a horizontally elongated top piece 15 and a horizontally elongated bottom piece 16. A relatively thin sheet metal "skin" 17 is fastened to the frame at the outer side of the building.

The other motor-operated door section 10*a* has the same construction and is a mirror image of door section 10. Elements of door section 10*a* which correspond to the elements of door section 10 are given the same reference numerals with an "a" suffix added.

The top pieces 15 and 15*a* of door sections 10 and 10*a* are slidable along respecting horizontal tracks T of conventional design which are fixedly mounted on the building above these door sections.

The door mover or operator for the sliding door section or master leaf 10 is designated generally by reference numeral 20 in FIG. 1. The door mover or operator for the sliding door section or master leaf 10*a* is designated generally by the reference 20*a*. Elements of the door mover 20a which correspond to those of door mover 20 are given the same reference numerals but with an "a" suffix.

Figure 6:
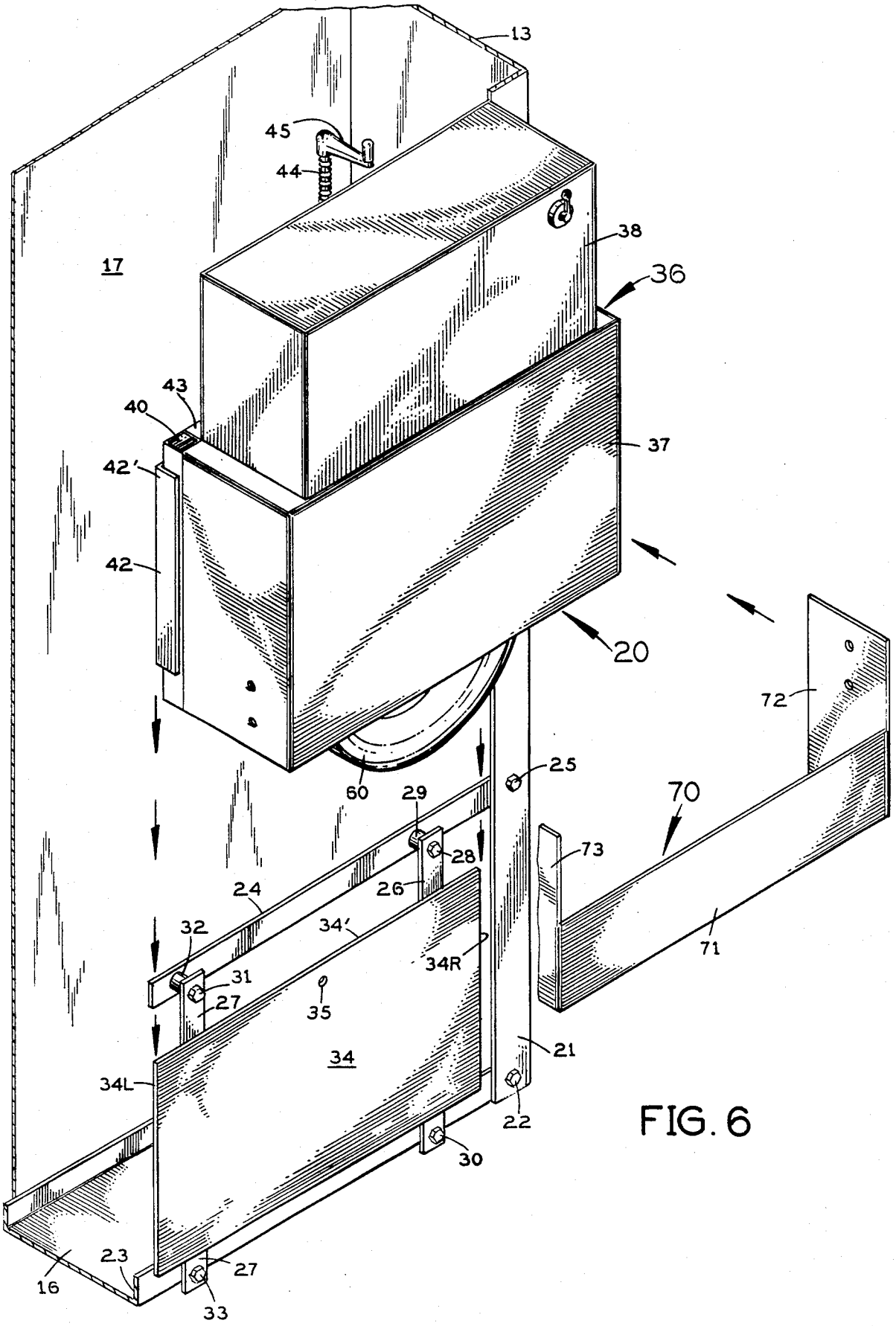
FIG. 6 is an exploded perspective view of the motorized drive unit and the support arrangement for mounting it on the inside of the corresponding sliding door.

Referring to FIG. 6, on the frame of the door section 10 toward the inside of the building the end piece 13 has an inturned, vertically elongated flange 21 which is bolted at 22 to the bottom piece 16 of this frame and also to the top piece 15 (not shown in the Figure). The bottom piece 16 of the door frame has an upstanding flange or lip 23 of the front which at one end engages the face of the end piece flange 21 toward the outside of the building.

A horizontally elongated, rigid, flat bar 24 is bolted at 25 to the end piece flange 21 on the door frame. The bar 24 extends above, parallel to and in the same vertical plane as the front flange 23 on the bottom piece 16 of the door frame.

A pair of rigid, fast, vertically elongated bars 26 and 27 extend between the horizontal bar 24 and the front flange 23 at locations spaced apart across the width of door 10. Vertical bar 26 at its upper end is rigidly connected to horizontal bar 24 by a bolt and nut assembly at 28, the bolt of which extends through a flanged annular spacer 29 engaged between the face of bar 24 toward the inside of the building and the face of bar 26 toward the outside of the building, as best seen in FIG. 1. Vertical bar 26 at its lower end is rigidly connected to flange 23 by a bolt and nut assembly at 30, the bolt of which extends through a similar spacer (not shown) engaged between flange 23 and bar 26. Similarly, vertical bar 27 at its upper end is rigidly connected to the horizontal bar 24 by a bolt and nut assembly at 31, the bolt of which extends through a flanged annular spacer 32 engaged between these bars. At its lower end vertical bar 27 is rigidly connected to flange 23 by a bolt and nut assembly at 33, the bolt of which passes through a similar spacer (not shown), which is engaged between flange 23 and bar 27.

Figure 2:
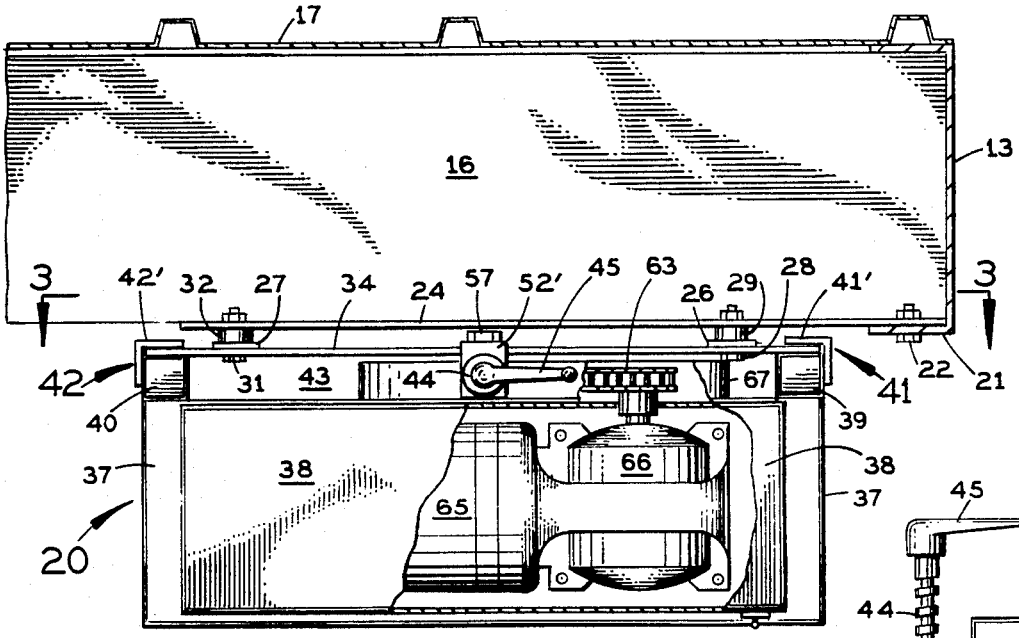
FIG. 2 is a horizontal cross-section taken along the line 2—2 in FIG. 1, looking down on the motorized drive unit for one of these doors and with parts broken away for clarity.

A rigid, flat, rectangular, support plate 34 is welded to the faces of vertical bars 26 and 27 toward the inside of the building so as to lie in a vertical plane located beyond (toward the inside of the building) the vertical plane of the flange 21 on the end piece 13 of the door frame, as best seen in FIG. 2. As shown in FIG. 6, plate 34 has a circular opening 35 located a short distance below its horizontal top edge 34' and midway between the vertical bars 26 and 27. Plate 34 has opposite vertical side edges 34L and 34R.

As shown in FIG. 1, a unitary housing assembly 36 for the door mover 20 includes a rectangular lower housing 37, a smaller rectangular upper housing 38, vertically elongated, rigid, opposite corner pieces 39 and 40 (FIG. 2) of rectangular cross-section on the back of the lower housing (toward the door), and vertically elongated angle irons 41 and 42 of right-angled cross-section welded respectively to the corner pieces on the sides. As shown in FIG. 2, the back leg 41' of angle iron 41 and the back leg 42' of angle iron 42 are both spaced behind the respective corner pieces 39 and 40 by just slightly more than the thickness of support plate 34.

Corner piece 39 and angle iron 41 form a first vertical channel on the housing assembly which is open at the bottom. Corner piece 40 and angle iron 42 form a similar channel which is laterally spaced from the first channel slightly more than the width of support plate 34 between its opposite side edges 34L and 34R. With this arrangement the housing assembly 36 can be slidably inserted from above (FIG. 6) down over the support plate 34 to a mounted position in which the housing assembly fits snugly on the plate, with the vertical channels formed by the corner pieces 39, 40 and the angle irons 41, 42 on the housing assembly receiving the support plate 34 along its opposite side edges 34L and 34R.

The housing assembly at the back (toward the door) has a horizontal extension or shelf 43 (FIG. 5) which extends between the tops of the corner pieces 30 and 40, i.e., at the top of the lower housing 37. A vertical lead screw member 44 has its lower end passing through an opening in housing extension 43 and has a handle or crank 45 on its upper end spaced above the top of the upper housing 38. At the lower end of its screw-thread the lead screw member has an integral cylindrical collar 46 engaging the top of a flanged annular bearing member 47 seated on top of the housing extension 43. Below this collar 46 the lead screw member presents a cylindrical segment 48 rotatably received in bearing member 47 and passing down through a correpsonding opening in the housing extension 43. The lower end of the lead screw member below the housing extension 43 is screw-threaded to receive a clamping nut 49. A flat annular metal washer 50 is engaged between the bottom of housing extension 43 and nut 49. With this arrangement the lead screw member 44 is fixedly positioned vertically with respect to the housing assembly 36.

Figure 5:
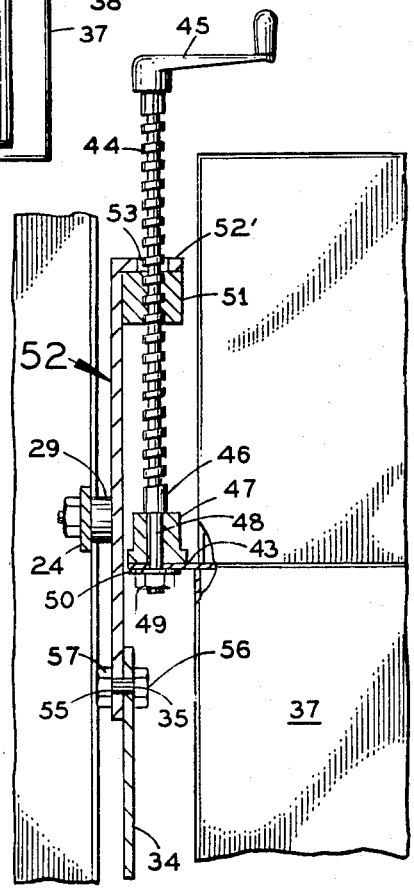
FIG. 5 is a fragmentary vertical section taken along the line 5—5 in FIG. 3 at the lead screw for raising and lowering the floor-engaging wheel.

Above its collar 46 the lead screw 44 member threadedly engages a nut member 51 affixed to a vertically elongated right-angled mounting piece 52. This mounting piece has a short horizontal top leg 52' with an opening 53 through which the lead screw member extends loosely down into threaded engagement with nut member 51. The long vertical leg of mounting piece 52 near its lower end has a circular opening 55 for registration with the opening 35 in support plate 34. When these two openings are aligned they can receive the shank of a bolt 56 on which a clamping nut 57 may be threaded to clamp the mounting piece 52 to plate 34, as shown in FIG. 5. With the arrangement the nut member 51 is fixedly positioned vertically with respect to the support plate 34 and the door section 10.

After the housing assembly 36 of the door mover has been slid down onto the support plate 34 and the bolt and nut 56,57 have been assembled to clamp the mounting piece 52 to plate 34, the handle 45 can be turned to rotate the lead screw 44 in the fixedly mounted nut 51 in one direction to raise the housing assembly 36 or in the opposite direction to lower it.

Figure 3:
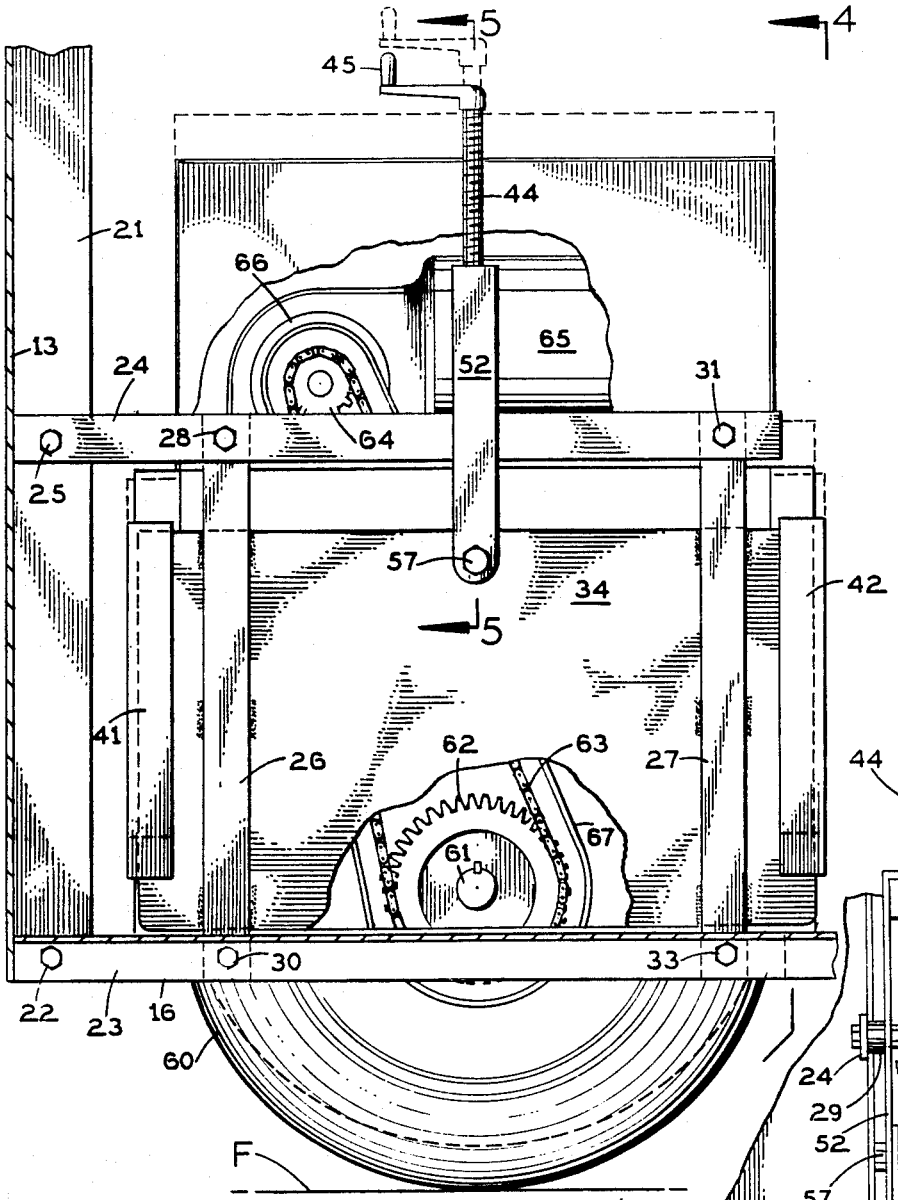
FIG. 3 is a vertical section taken along the line 3—3 in FIG. 2 at the side of the motorized drive unit away from the inside of the building.

The lower housing 37 rotatably supports a rubber-tired wheel 60 which projects down from it for rolling engagement with the floor F of the building just behind the door 10. Referring to FIG. 3, the axle 61 of wheel 60 carries a relatively large diameter gear 62 driven by an endless flexible chain 63 which at its upper end loop is engaged by a small sprocket 64. An electric motor 65 inside the upper housing 38 drives sprocket 64 through reduction gearing in a gear box 66. The drive chain 63, sprocket 64 and gear 62 of the wheel axle are partly enclosed by a chain guard 67.

As shown in FIG. 6 but not in the other figures, the housing assembly has a wheel cover 70 presenting a flat segment 71 which covers all but the lowermost fraction of an inch of the wheel 60 at the side of the door mover toward the inside of the building. The wheel cover has upstanding opposite end segments 72 and 73 which are attachable to the opposite end walls of the lower housing 37, such as by sheet metal screws.

Figure 4:
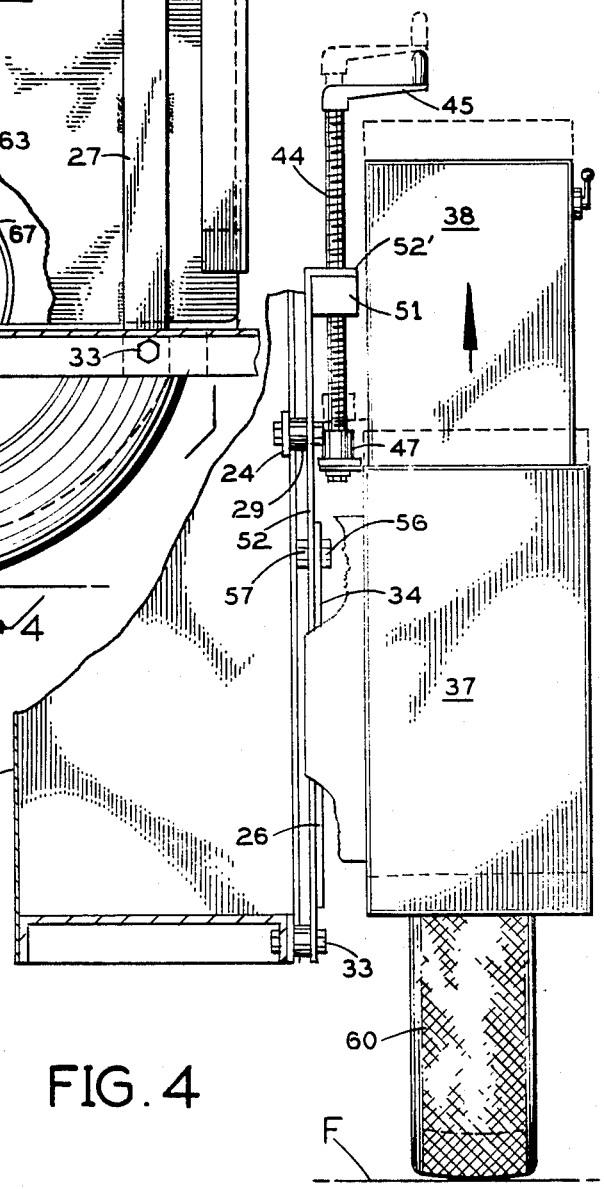
FIG. 4 is a view taken along the line 4—4 in FIG. 3 and showing the drive unit in end elevation, with certain parts broken away.

The housing assembly 36, manually operable lead screw member 44 and motor-driven wheel 60 form a unitary door mover which can be removed as a unit from the door-mounted support plate 34 or mounted as a unit on that plate. When this door mover is first put on the plate 34, the rubber-tired wheel 60 may be a short distance off the floor F, as shown in phantom in FIG. 4, in which case the door mover is on the door but cannot be used to move the door. The handle 45 may be turned in a direction to lower the rubber-tired wheel 60 into frictional rolling engagement with the floor, so that when motor 65 is turned on, this wheel causes the door 10 to move in the corresponding direction. If an electrical power failure occurs or the motor drive becomes disabled for some other reason, the handle 45 may be turned to raise the rubber-tired wheel 60 off the floor so that the door section can be opened or closed by a person pushing on it.

I claim:

1. A motorized drive unit for a sliding door section comprising:

a unitary housing assembly;

a wheel rotatably mounted in said housing assembly and extending below said housing assembly for rolling engagement with a floor adjacent the door section;

a motor in said housing assembly;

drive means in said housing assembly acting between said motor and said wheel for imparting rotation to the wheel from the motor;

means for mounting said housing assembly on said door section;

and manually operable means mounted on said housing assembly and selectively operable to raise or lower said housing assembly on said door section, whereby to position said wheel in or out of engagement with the floor.

2. A drive unit according to claim 1 wherein said manually operable means comprises:

a rotatable vertically extending lead screw member and a nut member threadedly engaging said lead screw member;

means fixedly positioning one of said members vertically with respct to said housing assembly;

and means for fixedly positioning the other of said members vertically with respect to the door section, whereby rotation of the lead screw member in one direction raises said housing assembly on said door section and rotation of the lead screw member in the opposite direction lowers said housing assembly on said door section.

3. A drive unit according to claim 1 wherein said means for mounting said housing assembly on said door section comprises:

a rigid support plate and means for positioning said support plate extending substantially vertically on one side of the door section;

and guide members on said housing assembly which snugly but slidably engage said support plate to permit up-and-down adjustment of said housing assembly on said support plate;

and said manually operable means comprises:

a rotatable vertically extending lead screw;

bearing means fixedly supported by said housing assembly and rotatably receiving said lead screw at its lower end, said bearing means fixedly positioning said lead screw vertically with respect to said housing assembly;

a nut threadedly engaging said lead screw above said bearing means;

and means for rigidly supporting said nut from said rigid support plate and holding said nut stationary with respect to said rigid support plate when the lead screw is rotated.

4. A drive unit according to claim 3 wherein:

said means for rigidly suppporting said nut comprises a rigid mounting piece holding said nut and means for attaching said mounting piece to said support plate.

5. A drive unit according to claim 3 wherein:

said support plate has opposite vertical side edges;

and said guide members define a pair of laterally spaced vertical channels which are open at the bottom for slidable insertion onto said support plate from above at said side edges of the support plate.

6. A drive unit according to claim 5 wherein:

said means for rigidly supporting said nut comprises a rigid mounting piece holding said nut and means for bolting said mounting piece to said support plate.

7. In a sliding door assembly for use on a building having a floor and a door opening above said floor, and means for slidably supporting a door section for horizontal movement across said door opening, the improvement which comprises:

a door section having a peripheral frame with a top, bottom and opposite ends and a panel extending across the front of said frame;

a drive wheel extending down for rolling engagement with the floor of the building adjacent said door opening, said wheel having a horizontal axis of rotation extending substantially perpendicular to said panel;

a motor above said wheel;

drive means acting between said motor and said wheel for imparting rotation to the wheel from the motor;

unitary housing means supporting said motor, drive means and wheel on said door section;

a rotatably vertically extending lead screw member;

a nut member threadedly engaging said lead screw member;

a handle for turning said lead screw member;

means fixedly positioning one of said members vertically with respect to said housing means;

and means fixedly positioning the other of said members vertically with respect to the door section frame whereby rotation of the lead screw member in one direction raises said housing means on said door section and rotation of the lead screw member in the opposite direction lowers said housing means on said door section.

8. A sliding door assembly according to claim 7 wherein:

said means fixedly positioning one of said members vertically with respect to said housing means comprises bearing means fixedly supported by said housing means and rotatably receiving said lead screw member at its lower end;

and said means fixedly positioning the other of said members vertically with respect to the door section frame is a mounting piece supported from said door section frame and holding said nut member stationary.

9. A sliding door assembly according to claim 8 wherein:

said lead screw member extends outside said housing means between said housing means and said door section panel;

and said mounting piece holding said nut member is between said housing means and said door section panel.

10. A sliding door assembly according to claim 9 and further comprising:

a rigid vertical support plate attached to said door section frame and positioned between said door section panel and said housing means, said support plate having opposite vertical side edges;

guide members on said housing means defining a pair of laterally spaced channels which are open at the bottom for slidable insertion onto said support plate from above at said side edges of the support plate, said guide members being slidably adjustable vertically on said support plate;

and means for bolting said mounting piece to said support plate.

* * * * *